US006443047B1

(12) United States Patent
Cunningham

(10) Patent No.: US 6,443,047 B1
(45) Date of Patent: Sep. 3, 2002

(54) RADIAL PISTON ENGINE WITH ROLLER GUIDES

(75) Inventor: Sinclair Cunningham, Kinghorn (GB)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 09/744,178

(22) PCT Filed: Jul. 9, 1999

(86) PCT No.: PCT/EP99/04835

§ 371 (c)(1),
(2), (4) Date: Jan. 19, 2001

(87) PCT Pub. No.: WO00/05502

PCT Pub. Date: Feb. 3, 2000

(30) Foreign Application Priority Data

Jul. 21, 1998 (DE) ..... 198 32 696

(51) Int. Cl.[7] ..... F02B 57/00
(52) U.S. Cl. ..... 91/491; 91/498
(58) Field of Search ..... 91/491, 492, 497, 91/498; 417/273; 92/58

(56) References Cited

U.S. PATENT DOCUMENTS 4,522,110 A * 6/1985 Samuelsson ..... 91/491
4,704,948 A * 11/1987 Wüsthof et al. ..... 91/491
4,719,843 A * 1/1988 Nöel ..... 91/491
4,724,742 A * 2/1988 Bigo et al. ..... 91/491
4,953,524 A * 9/1990 Wüsthof et al. ..... 91/491
5,179,889 A * 1/1993 Wüsthof et al. ..... 91/491
5,391,059 A * 2/1995 Hallundbæk ..... 91/498
5,632,191 A * 5/1997 Lemaire et al. ..... 91/491

FOREIGN PATENT DOCUMENTS

DE 39 26 354 A1 * 2/1991 ..... 91/491
EP 0046691 3/1982 ..... 91/491
GB 2238086 5/1991 ..... 91/491

* cited by examiner

*Primary Examiner*—Thomas Denion
*Assistant Examiner*—Thai-Ba Trieu
(74) *Attorney, Agent, or Firm*—Martin A. Farber

(57) ABSTRACT

A hydraulic radial piston machine having a lifting ring and having a cylinder block which is arranged with respect to the lifting ring in a manner allowing it to rotate about an axis of rotation and has a multiplicity of cylinders oriented in the radial direction of the cylinder block. Each of these cylinders accommodates a displaceable piston which is supported on the lifting ring via a roller. The roller is mounted on the piston in a manner allowing it to rotate about an axis of rotation parallel to the axis of rotation of the cylinder block and is held in the direction of its axis of rotation axially in the cylinder via roller guides which are situated in front of its end sides and are torsionally secured with regard to the axis of the cylinder relative to the cylinder block. To obtain the torsional securing of the piston and roller about the axis of the cylinder with little outlay in this hydraulic radial piston engine at least one of the two roller guides of a roller is torsionally secured directly with respect to the cylinder-block without an additional part.

12 Claims, 3 Drawing Sheets

RADIAL PISTON ENGINE WITH ROLLER GUIDES

FIELD AND BACKGROUND OF THE INVENTION

The invention proceeds from a radial piston machine whose pistons are subjected on the inside to pressure and are in each case supported on the lifting ring via a roller held axially on the end sides by roller guides.

The publication GB 2 238 086 B discloses a radial piston machine which has these features and for which the outlay on manufacturing techniques, associated up to now with the axial positioning of the rollers, and therefore the manufacturing and assembly costs are intended to be reduced. This object is intended to be achieved by the fact that a wedge-shaped piece having a circular-segment-like cross section, as viewed in the stroke direction of the piston, is arranged in each case as a roller guide in the spaces between the roller end sides and the cylinder inner surface, said wedge-shaped piece positioning the roller axially in the cylinder with respect to the lifting ring. The wedge-shaped pieces disclosed in the above-mentioned publication can essentially be divided into three different constructional types.

In a first type, each wedge-shaped piece has, on the side facing the roller, a planar surface bearing against the end side of the roller and, on the side facing away from the roller, a cylindrical surface in contact with the inner surface of the cylinder. In addition, this wedge-shaped piece is accommodated in the space between the roller, the piston and cylinder wall without being firmly connected to any of these components. Because the wedge-shaped piece is able to move freely in the piston direction with respect to the roller, the piston drives the wedge-shaped pieces in the direction of the lifting ring during a loading stroke. In the process, there is still no contact between the wedge-shaped pieces and the cams formed on the lifting ring. In contrast, during the subsequent return stroke of the piston the wedge-shaped pieces abut against the cams formed on the lifting ring and are pushed inward.

In a second constructional type, each of the two wedge-shaped pieces has, on the side facing the roller, a driver-like projection which extends between the piston and roller in the direction of the other wedge-shaped piece in a cutout provided on the piston. In this case, the wedge-shaped pieces are again driven by the roller into the cylinder during the return stroke of the piston.

In order to ensure the required rotational position of the piston and therefore of the rollers in the cylinder even if the rollers do not have any contact with the lifting ring, according to a third constructional type, one of the two wedge-shaped pieces has, on the side facing the cylinder wall, an elongated groove in which a locking bar in the form of a screw, clamp or the like, which is held on the cylinder wall, engages and thereby prevents torsion of the piston in the cylinder and therefore of the roller with respect to the lifting ring. An additional part is therefore required in order to torsionally secure the wedge-shaped piece and therefore the piston and roller with regard to the axis of the cylinder, and so the outlay on manufacturing is high.

SUMMARY OF THE INVENTION

The object of the invention is to develop a radial piston machine of the above-mentioned type in such a manner that it can be produced with a lower outlay with functionally reliable operation being ensured.

According to the invention, this object is achieved wherein at least one of the two roller guides of a roller is torsionally secured directly with respect to the cylinder block without an additional part. The outlay on production for the radial piston machine is therefore considerably reduced. This is because the manufacturing or the purchase, handling and the assembly of the locking bar engaging in the roller guide are rendered superfluous.

Thus, according to a feature of the invention a roller guide has a projection on its side facing away from the roller, while the cylinder is provided with a groove which runs in the axial direction and accommodates the projection of the roller guide in a form-locking manner in the direction of rotation about the axis of the cylinder. The roller guides are generally made of a plastic material, so that the projection on the roller guide can easily be worked from the solid or, if the roller guide is produced by injection molding, can be formed on it at the same time. After the working of the cylinder, a groove in the cylinder can be milled out If said groove advantageously extends inward from the open end of the cylinder, it may also be obtained by a small hole being initially made in the cylinder block and cutting being initiated there as a cylinder is being worked.

So that the roller guide is not subjected to pressure, according to another feature of the invention the groove in the cylinder extends inward until it is radially outside a point at which the lower side of the piston, which lower side faces away from the roller, is in its extended dead center. In particular, according to still another feature of the invention the position of the inner end of the groove, the position of a piston cup which is held on the piston and seals the gap between it and the cylinder, and the travel distance of the piston are matched to one another in such a manner that the piston cup does not reach into the region of the groove.

Advantageously, according to yet another feature of the invention the projection on the roller guide is a ridge which runs in the axial direction of the cylinder, so that a certain length is available for the form-locking engagement between the projection on the roller guide and the groove of the cylinder. The ridge on a roller guide is preferably situated in the center of the roller guide, as viewed in the axial direction of the cylinder, so that the roller guide is indifferent as regards the direction in which torsion of the piston and of the roller is prevented, and forces are introduced into the roller guide at its thickest point. In addition, during assembly the roller guide can be inserted into the intermediate space between the roller and the cylinder in two positions rotated by 180° with respect to each other if the projection or the ridge lies symmetrically with respect to a plane running perpendicularly to the axis of the cylinder halfway up the roller guide.

According to still another feature of the invention, the contour of a groove of the cylinder, as viewed in the axial direction of the cylinder, is preferably formed by a circular arc because then the groove, as already indicated, can be worked in a particularly simple manner.

If both roller guides of a roller are torsionally secured with respect to the cylinder block, the forces required for the securing are divided over two roller guides, with the result that the projection or the ridge on the roller guides can be relatively low and the grooves in the cylinder can be relatively flat.

BRIEF DESCRIPTION OF THE DRAWING

To exemplary embodiments of a hydraulic radial piston machine according to the invention are illustrated in the drawings. The invention is now explained in greater detail with reference to the figures of these drawings, in which.

DETAILED DESCRIPTION OF THE PREFERRED EMBODIMENT

Figure 1:
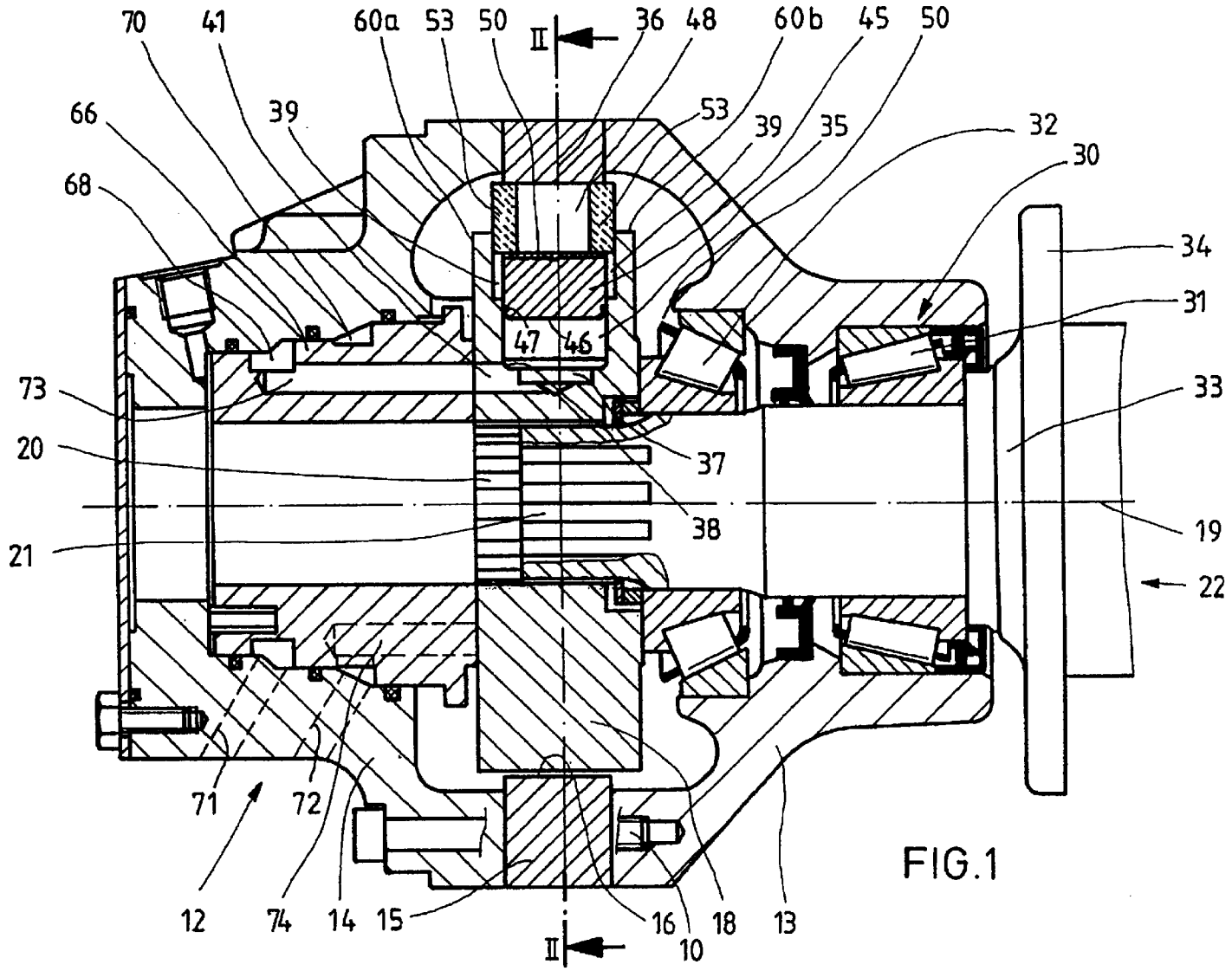
FIG. 1 shows, in the upper half, a longitudinal section through the first exemplary embodiment in a first plane and, in the lower half, a longitudinal section through a second plane.
Figure 2:
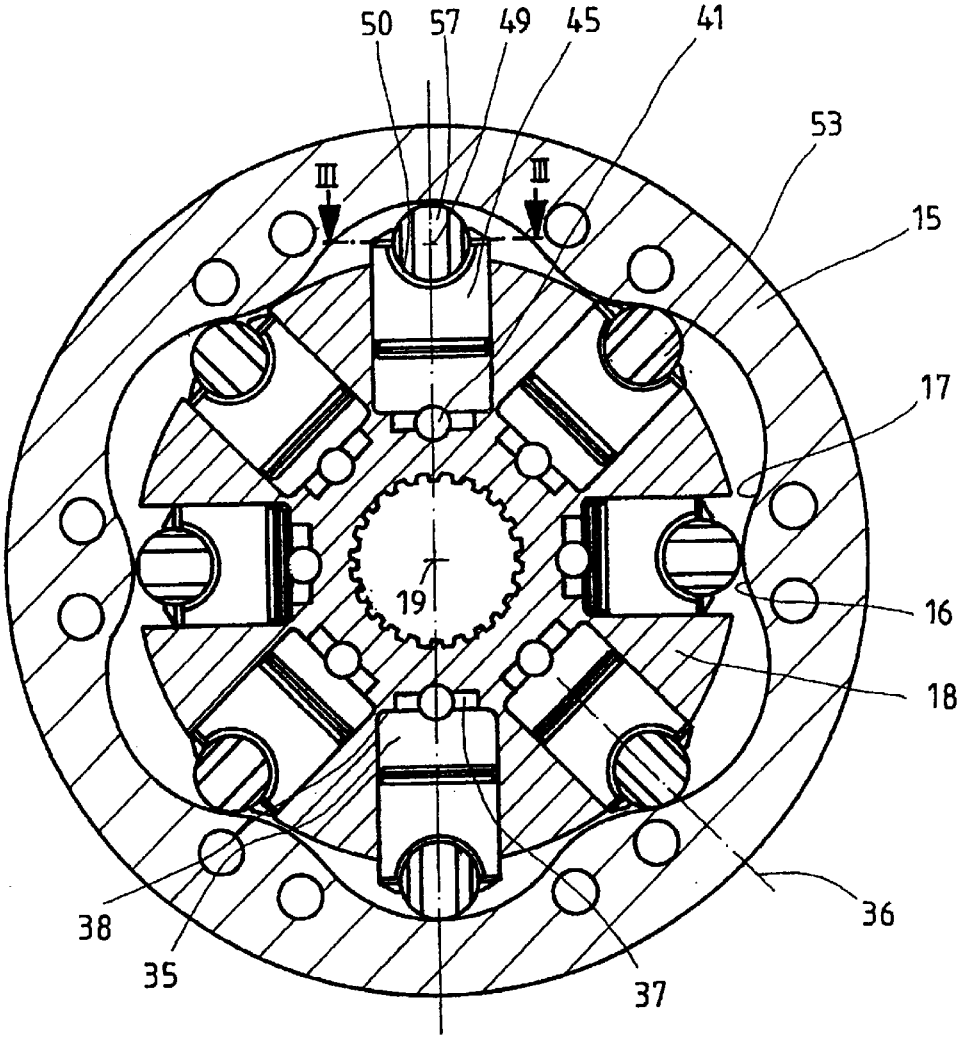
FIG. 2 shows a section along the line II—II from FIG. 1 of a sectional view of the piston and roller guides.

The radial piston machine shown in its entirety in FIGS. 1 and 2 is primarily used as a radial piston motor and has a housing 12 which is essentially composed of two housing cups 13 and 14 and a lifting ring 15 arranged between them. Said three parts are held coaxially and fluid-tightly against one another by means of screws 10. The inner surface of the lifting ring 15 is formed as a lifting curve 16 having a multiplicity of inwardly projecting cams 17, as can clearly be seen from FIG. 2. Situated within the lifting ring 15 is a cylinder block 18 which can rotate about an axis of rotation 19 coinciding with the axes of the housing parts. The cylinder block 18 has a central passage 20 which is provided with an internal toothing in which one end section 21 of a driven shaft 22, which is provided with an external toothing corresponding to the internal toothing of the passage 20, is accommodated in an axially displaceable manner. The driven shaft 22 is mounted rotatably with respect to the housing 12 via a bearing arrangement 30. The bearing arrangement comprises two tapered roller bearings 31 and 32 which are accommodated in the housing part 13 and can transmit high axial and radial forces. The second end section 33 of the driven shaft 22 protrudes out of the housing part 13 and outside the latter has a shaft flange 34 for fastening to a driving element (not illustrated) of an implement to be driven, for example to a wheel of a loader.

Figure 3:
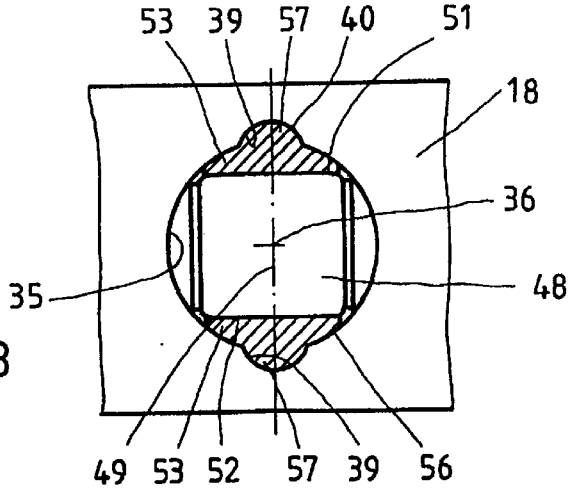
FIG. 3 shows a section along the line III—III from FIG. 2.

Formed in the cylinder block 18 are a multiplicity of cylinders 35 which are oriented radially in a star-shaped manner with regard to the axis of rotation 19, are open outward toward the lifting ring 15 and can be regarded as circular cylinders having the same diameter throughout and having a respective cylinder axis 36 which is perpendicular with regard to the axis of rotation 19 of the cylinder block 18. Centrally on the bottom side each cylinder 35 has a flat depression 37 with a reduced diameter, thereby providing an annular shoulder 38 as a bearing surface for the piston 45 which is situated in the cylinder. Each cylinder 35 is assigned an access hole 41 which runs in the cylinder block 18 parallel to its axis of rotation 19, starts at one end side of the cylinder block, opens into the cylinder on both sides of the shoulder 38 and via which hydraulic fluid is supplied and removed during operation of the radial piston motor. Each cylinder 35 also has, in its wall, two grooves 39 which lie diametrically opposite in the direction of the axis of rotation 19 of the cylinder block and whose contour, as is revealed in particular in FIG. 3, is formed by a circular arc 40 and whose depth approximately corresponds to one third of the wall thickness of the cylinder block 18 in the region of the grooves. The two grooves 39 extend inward in the direction of a cylinder axis 36 approximately to halfway up a cylinder 35. Running around the piston 45, which is accommodated in a cylinder 35, at a short distance from the lower side 46, which faces inward, is an annular groove in which a piston cup 47 is accommodated. As is revealed in FIG. 1 in which the piston 45 which is shown there is extended completely outward and takes up its upper dead center, in this position of the piston the piston cup 47 is situated below the grooves 39, with the result that the working space between the lower side 46 of the piston 45 and the bottom of the cylinder 35 is always sealed off from the grooves 39.

During operation, the working spaces of the cylinders 35 are in each case connected alternately and offset with respect to one another in pairs as a function of the relative position between the cylinder block 18 and the housing part 12 via the respective access hole 39 to the high-pressure side of a pressure-medium source or are relieved of pressure. When subjected to pressure, a force directed outward in the direction of the lifting ring 15 acts on a piston 45. In the process, the piston is supported on the lifting ring 15 via a roller 48. Said roller is situated in a holder of the piston 45, in which it is encompassed by more than 180°, with the result that it can only be fitted in the direction of its axis 49. Clipped in each holder is a thin bearing shell 50 made of a bearing metal on which the roller rests.

The rollers 48 are barrels having two end sides 51, 52 lying perpendicularly with respect to the axis 49, and are inserted by more than half into the cylinders 35 when the pistons 45 are displaced radially inward in the cylinders 35 as they run onto a cam 17 of the lifting curve 16. This means cylinder 35 and that in a wide stroke range of the pistons 45 there is a distance between the circular edges, which are formed by the end surfaces and the cylindrical surface of a roller, and the wall of the cylinders 35. Without additional measures the rollers could be displaced in the direction of their axis 49 and abut against the cylinder block 18 during the return stroke of the piston. This could lead to damage of the parts and to the motor breaking down. In order to prevent this, a roller guide 53 is arranged in front of each of the two end sides 51 and 52 of a roller 48 and as a result the position of each roller 48 in the direction of its own axis is predetermined with regard to a cylinder 35 and therefore with regard to a piston 45 and with regard to the lifting curve 16. The roller guides 53 for each roller 48 are each arranged in a space present between the end side 51 or 52 of the roller 48, the piston 45 and the cylinder wall of the cylinder 35 and are identical to each other. In the direction of the piston stroke, i.e. as viewed in the direction of the axis 36 of a cylinder 35, a roller guide 53 has an essentially circular-segment-shaped cross section. In the design according to FIGS. 1 to 3, the roller guides bear with a closed, planar surface against the end sides 51 and 52 of the roller 48.

Figure 4:
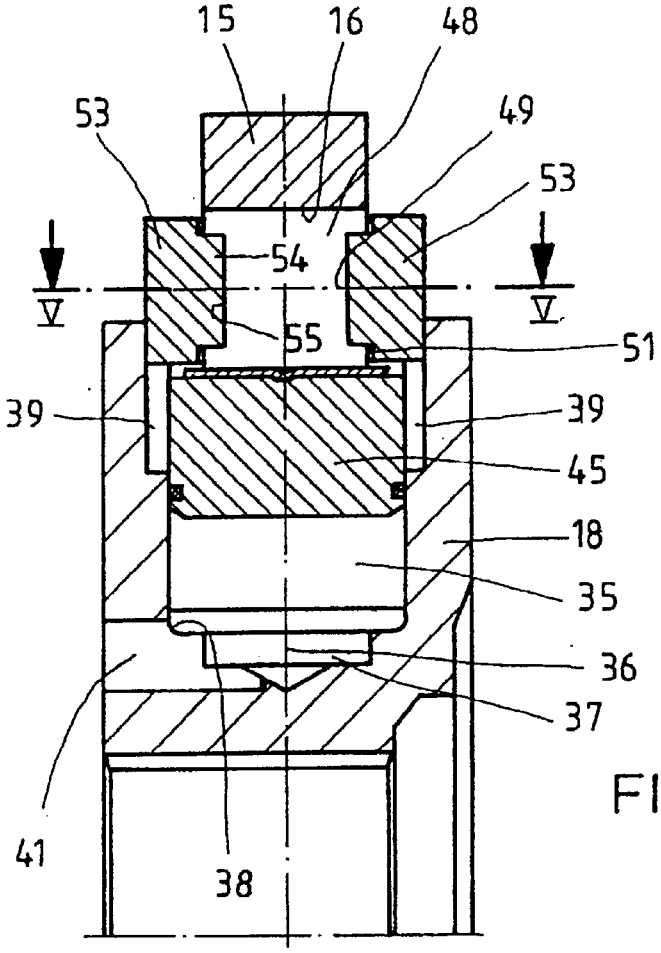
FIG. 4 shows a partial longitudinal section through a second exemplary embodiment having a different form of roller guides.
Figure 5:
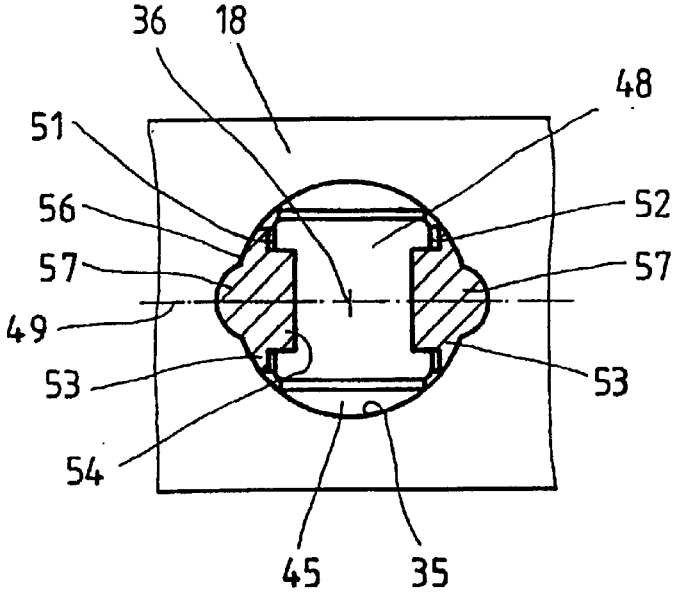
FIG. 5 shows a section along the line V—V from FIG. 4.

In contrast, in the design according to FIGS. 4 and 5, they have, facing the roller 48, a circular cylindrical channel 54 which is axial with regard to the axis 49 of a roller and engages with suction in a corresponding, central recess 55 on the end side 51 or 52. The length of the channel 54 is somewhat greater than the depth of a recess 55, with the result that there is a small distance between the ring surface of a roller guide 53 about the channel 54 and the corresponding ring surface on the end side 51 or 52 of a roller 48. In the design according to FIGS. 4 and 5, in which the width of the lifting ring in the direction of the axis of the cylinder block 18 is approximately identical to the length of the rollers 48, the roller guides 53 are driven by the roller 48 via the channel 54 during the retraction and extension of the piston 45. The roller guides 53 of the exemplary embodiment according to FIGS. 4 and 5 which, like those according to the exemplary embodiment of FIGS. 1 to 3, have, in a view in the direction of the axis 49 of a roller 48, a circular outer contour having two opposite flattened portions, therefore also have a diameter which is slightly smaller than the diameter of a roller 48. The diameter of the roller guides 53 according to the exemplary embodiment of FIGS. 1 to 3 is identical to the diameter of a roller 48. In this case, the roller guides are moved outward by the piston 45 and inward by the cams of the lifting ring 15. The essentially cylindrical outer surface 56, facing away from a roller 48, of each roller guide 53 bears against the wall of the cylinder 35. As a result, the roller guides 53 cannot be twisted with regard to the axis of rotation 49 of a roller 48. The relative rotational movement between the roller and roller guides takes place on the end sides 51 and 52 of the roller. By means of the roller guides a roller 48 is extended, as it were, and adapted to the circular cylindrical cross section of a cylinder 35, with the result that the rollers are unable to shift in the direction of their axis during the entire stroke of a piston 45.

Without further measures, the pistons 45 together with the rollers 48 would not be prevented from twisting about the axis 36 of a cylinder 35. In order to obtain torsional securing about this axis, each roller guide 53 is provided in the center of its outer surface 56 with a ridge 57 which runs in the direction of the axis 36 over the entire height of a roller guide and is adapted in its cross section to the cross section of the grooves 39 of the cylinder 35 and is held by the latter in a form-locking manner in the direction of rotation about the axis 36 of the cylinder 35. The piston 45 and roller 48 are thereby prevented, without additional parts, from twisting about the axis 36 of the cylinder 35 and a roller is prevented from acting upon the lifting curve 16 on the lifting ring 15 in a sloping position. The ridge 57 can easily be shaped on the roller guides 53 which are produced from a plastic material.

The reference number 66 denotes a commutator via which hydraulic fluid is supplied to the working spaces of the cylinders 35 via the access holes 41 or is removed from the working spaces during operation of the radial piston motor. The commutator is arranged in a fluid-tight and rotationally secure manner in the housing part 14. Two annular spaces 68 and 70 are formed between it and the housing part 14, said annular spaces being separated from each other and being respectively connected to an inflow channel 71 and outflow channel 72 leading to the outside. Uniformly distributed starting from that end side of the commutator 66 which faces the cylinder block 18 is a number of axial blind holes 73, which begin to overlap the annular space 68, which number corresponds to the number of cams 17 of the lifting curve 16. Shorter blind holes 74, which are connected to the annular space 70, run between two blind holes 73 in each case, likewise from the said end side of the commutator and at the same distance from the axis of rotation 19 as the blind holes 73. During operation, as a roller 48 runs onto a cam 17 of the lifting curve 16, hydraulic fluid is displaced at zero pressure out of the working space of the corresponding cylinder 35 via the hole 41 of the cylinder block 18 and via one of the blind holes 74. In the region of the crest of a cam 17 the hole 41 passes from being overlapped by the corresponding hole 74 and shortly after that is overlapped by one of the holes 73. Hydraulic fluid is now supplied to the working space, with the result that the piston 45 is displaced outward and as the roller 48 rolls off a cam 17 a torque is produced.

What is claimed is:

1. A hydraulic radial piston machine having a lifting ring (15) and having a cylinder block (18) which is arranged with respect to the lifting ring (15) in a manner allowing it to rotate about an axis of rotation (19) and has a multiplicity of cylinders (35) which are oriented in the radial direction of the cylinder block (18) and in each of which is accommodated a displaceable piston (45) which is supported on the lifting ring (15) via a roller (48), the roller (48) being mounted on the piston (45) rotatable about an axis of rotation (49) parallel to the axis of rotation (19) of the cylinder block (18) and being held axially in direction of said axis of rotation (49) in the cylinder (35) via individual roller guides (53) for the rollers of respective pistons, which roller guides are situated in front of its end sides (51, 52) and are torsionally secured with respect to the axis (36) of the cylinder (35) relative to the cylinder block (18), wherein at least one of the two roller guides (53) of a roller (48) is torsionally secured directly with respect to the cylinder block (18) without an additional part.

2. The hydraulic radial piston machine as claimed in claim 1, wherein a roller guide (53) has a projection (57) on its side (56) facing away from the roller (48), and that the cylinder (35) is provided with a groove (39) which runs in the direction of its axis (36) and accommodates the projection (57) of the roller guide (53) in a form-locking manner in direction of rotation about the axis (36) of the cylinder (35).

3. The hydraulic radial piston machine as claimed in claim 2, wherein the groove (39) extends inward from the open end of the cylinder (35).

4. The hydraulic radial piston machine as claimed in claim 3, wherein the groove (39) extends inward in the cylinder (35) until radially outside a point at which a lower side (46) of the piston (45), which lower side faces away from the roller (48), is in its extended dead center.

5. The hydraulic radial piston machine as claimed in claim 4, wherein the groove (39) ends radially outside the travel distance of a piston cup (47) which is held on the piston (45) and seals a gap between the piston and the cylinder (35).

6. The hydraulic radial piston machine as claimed in claim 2, wherein the projection (57) on the roller guide (53) is a ridge running in the axial direction of the cylinder (35).

7. The hydraulic radial piston machine as claimed in claim 6, wherein the ridge (57) on a roller guide (53) is situated in the center of the roller guide (53), as viewed in the axial direction of the cylinder (35).

8. The hydraulic radial piston machine as claimed in claim 2, wherein contour of a groove (39) of the cylinder (35) is formed by a circular arc (40), as viewed in the axial direction of the cylinder (35).

9. The hydraulic radial piston machine as claimed in claim 1, wherein the two roller guides (53) of a roller (48) are directly torsionally secured with respect to the cylinder block (18) without an additional part.

10. The hydraulic radial piston machine as claimed in claim 1, wherein the roller guides (53) have, on a side facing an end side (51, 52) of the roller (48), a projection (54) which engages in a recess (55) formed on the end side (51, 52) of the roller (48).

11. The hydraulic radial piston machine as claimed in claim 1, wherein the roller guides (53) are displaceable outward by the piston (45) and inward by the lifting ring (15).

12. The hydraulic radial piston machine as claimed in claim 1, wherein, during a displacement of a piston radially inward into its cylinder, the roller carried by the piston can enter into a circular cross section of the cylinder.

* * * * *